US010058186B2

(12) United States Patent
Rivera

(10) Patent No.: US 10,058,186 B2
(45) Date of Patent: Aug. 28, 2018

(54) SCREENING DEVICE

(71) Applicant: Ana M. Rivera, Henderson, NV (US)

(72) Inventor: Ana M. Rivera, Henderson, NV (US)

(73) Assignee: Ana M. Rivera, Orlando, FL (US)

( * ) Notice: Subject to any disclaimer, the term of this patent is extended or adjusted under 35 U.S.C. 154(b) by 0 days.

(21) Appl. No.: 14/533,422

(22) Filed: Nov. 5, 2014

(65) Prior Publication Data

US 2016/0120323 A1 May 5, 2016

(51) Int. Cl.

| | |
|---|---|
| ***A47C 7/66*** | (2006.01) |
| ***E04H 15/48*** | (2006.01) |
| ***E04H 15/02*** | (2006.01) |
| *A47C 1/14* | (2006.01) |

(52) U.S. Cl.

CPC ..... *A47C 7/66* (2013.01); *E04H 15/02* (2013.01); *E04H 15/48* (2013.01); *A47C 1/143* (2013.01)

(58) Field of Classification Search

CPC ..... E04H 15/02; E04H 15/38; E04H 15/405; E04H 15/48; E04H 15/58; A47C 7/66; Y10T 403/32254; Y10T 403/32262; Y10T 403/32319; Y10T 403/32327; Y10T 403/32361; Y10T 403/32368; Y10T 403/32418; Y10T 403/32426

USPC ..... 297/180.17; 135/133; 403/93, 96, 97, 403/103

See application file for complete search history.

(56) References Cited

U.S. PATENT DOCUMENTS

| | | | | | |
|---|---|---|---|---|---|
| 270,224 | A * | 1/1883 | Johnson et al. | A47C 7/66 | 135/133 |
| 4,093,305 | A * | 6/1978 | Staroste | A45B 23/00 | 297/184.17 |
| 4,343,322 | A * | 8/1982 | Fiddler | E04F 10/04 | 135/133 |
| 4,506,689 | A * | 3/1985 | Fiddler | A47C 7/66 | 135/117 |
| 4,739,784 | A * | 4/1988 | Fast | E04H 15/38 | 135/117 |
| 4,890,950 | A * | 1/1990 | Yoo | E06C 1/32 | 16/328 |
| 4,978,166 | A * | 12/1990 | James | A47D 15/00 | 297/184.13 |
| 5,013,085 | A * | 5/1991 | Craig | A47C 1/143 | 135/90 |
| 5,320,405 | A * | 6/1994 | Foster | A47C 7/66 | 135/133 |

(Continued)

*Primary Examiner* — David R Dunn
*Assistant Examiner* — Danielle Jackson

(57) ABSTRACT

A screening device detachably joins with furniture, such as a lounge chair to screen against the elements by pivoting between an expanded position for screening, and a retracted position for stowing. A plurality of support members form the structural support of the device and carry a canopy. A strut and an adjacently attached disc extend from the terminal ends of each support member. A cog wheel attaches to the discs for regulating movement of the support members, and includes a central axle and peripheral rods that extend from one side of the cog wheel. The central axle passes through a central aperture. Each peripheral rod passes through a corresponding peripheral aperture in the discs. A spring biases the cog wheel into engagement with the discs to restrain the support members. A release member presses against the spring to release the support members for movement between positions.

17 Claims, 7 Drawing Sheets

(56) References Cited

U.S. PATENT DOCUMENTS

| | | | | |
|---|---|---|---|---|
| 5,511,259 | A * | 4/1996 | Tarara | A47C 7/66 135/133 |
| 5,551,745 | A * | 9/1996 | Huang | B60J 7/1282 135/133 |
| 6,170,910 | B1 * | 1/2001 | Bapst | A47C 7/66 16/377 |
| 6,343,406 | B1 * | 2/2002 | Yeh | E05D 11/1007 16/328 |
| 7,631,575 | B2 * | 12/2009 | Gard | F16C 11/10 74/530 |
| 2004/0131801 | A1 * | 7/2004 | Wong | A01K 1/033 428/12 |
| 2006/0054207 | A1 * | 3/2006 | Wootliff | A47C 29/003 135/96 |
| 2008/0142062 | A1 * | 6/2008 | Carrieri | E04H 15/38 135/117 |
| 2011/0146737 | A1 * | 6/2011 | Friedman | E04H 15/003 135/88.13 |
| 2011/0297198 | A1 * | 12/2011 | Sibley | A61G 15/10 135/88.01 |
| 2012/0012144 | A1 * | 1/2012 | Cebular | A47C 1/143 135/96 |
| 2012/0042920 | A1 * | 2/2012 | Armstrong | E04H 15/003 135/153 |
| 2016/0010358 | A1 * | 1/2016 | Ashley | E04H 15/02 135/96 |

* cited by examiner

SCREENING DEVICE

CROSS-REFERENCE TO RELATED APPLICATIONS

Not Applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a screening device. More particularly, the invention relates to a screening device for use with furniture, having a canopy mounted on support members that pivot between an expanded position for screening, and a retracted position for stowing.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that an outdoor lounge chair is a folding chair, usually with a frame of treated wood or other material. The outdoor lounge chair can include a portable folding chair, with a single strip of fabric or vinyl forming the backrest and seat.

Typically, the sun lounge chair is meant for leisure, on the beach, pool, park, or on the deck of a cruise ship. The sun lounge chair is easily transportable and stackable. Different versions may have an extended seat, meant to be used as a leg rest, whose height may be adjustable; and may also have arm rests. It is known that the sun lounge chair is mostly used outdoors, as an article of patio, garden, swimming pool deck, or beach-side outdoor furniture. This outdoor use leaves the user of the sun lounge chair exposed to the elements of nature.

In many instances, an umbrella is used to shield the user form the elements, such as sun, wind, and rain. The umbrella is large and not always available with the sun lounge chair. The umbrella must also have a surface to mount upon. A sun visor can be used also. However, the sun visor only covers a portion of the head, leaving the rest of the body exposed.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates the screening device in an exemplary retracted position, and FIG. 2B illustrates the screening device in an exemplary expanded position, in accordance with an embodiment of the present invention;

FIG. 4A illustrates four exemplary support members, and FIG. 4B illustrates the canopy covering the support members, in accordance with an embodiment of the present invention;

FIG. 7A illustrates exemplary disc and struts, FIG. 7B illustrates exemplary central axle and peripheral rods for a disc, and FIG. 7C illustrates a rear end of the disc, in accordance with an embodiment of the present invention.

Figure 1:
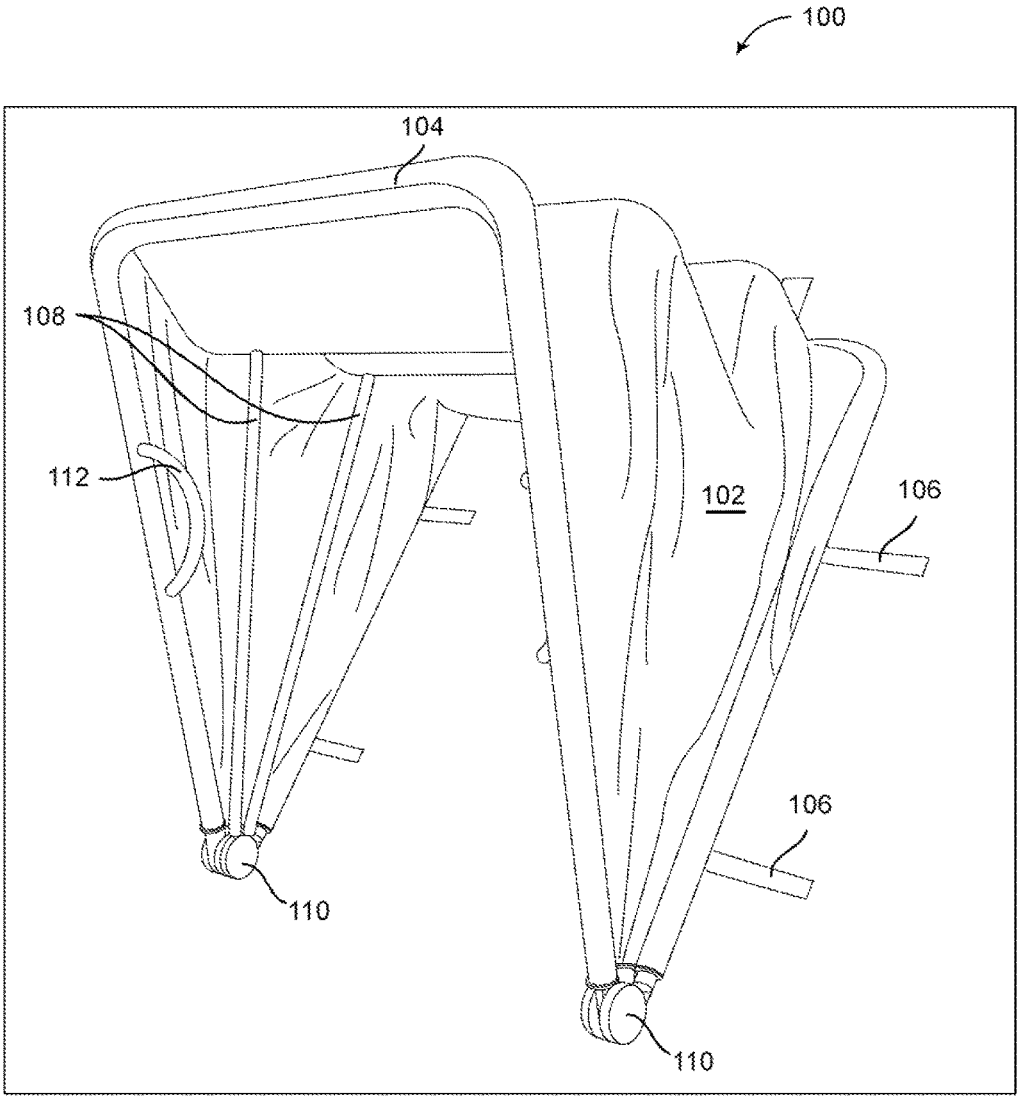
FIG. 1 illustrates a detailed perspective view of an exemplary screening device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicant hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The present invention will now be described in detail with reference to embodiments thereof as illustrated in the accompanying drawings.

There are various types of screening devices for sun lounge chairs that may be provided by preferred embodiments of the present invention. In one embodiment of the present invention, a screening device detachably joins with furniture, such as a sun lounge chair to provide protection against the elements. The device pivots relative to the furniture between an expanded position for screening, and a retracted position for stowing.

In some embodiments, the device may be portable for detachably joining with the furniture. The device may include variable lengths and an adjustable curvature in a longitudinal direction for optimal flexibility while providing a protective screen. The device pivots between an expanded position for providing a protective screen to an object on the furniture, and a retracted position for stowing the device on the furniture when not in use. The furniture may include, without limitation, a sun lounge chair, a beach chair, a deck chair, a folding chair, a pool chair, a couch, and any chair that folds flat by a scissors action round a transverse axis.

In some embodiments, the device may include a plurality of support members that form the structural support of the device and configured to carry a canopy. The support members may be configured to move the canopy in an accordion mechanism between the expanded and retracted positions. In one embodiment, the device comprises four support members. The support members may align in a generally parallel series, and with each support member having a substantially U-shaped configuration. In some embodiments, a strut and an adjacently attached disc extend from the terminal ends of each support member. Each support member, thus may have two struts and two discs extending therefrom.

In some embodiments, each strut integrates into the corresponding support member to help resist longitudinal compression and create additional support. Each disc is configured to interact with its companion disc to enable pivoting of the support members, and also to retain the support members in a selected position relative to the furniture. Each disc comprises a central aperture for enabling pivoting, and a plurality of peripheral apertures for alignment and retaining each arched member in a selected position relative to the furniture. In this manner, the companion support members pivot on the discs relative to each other, and relative to the furniture. In some embodiments, the discs may have differences in diameter, shape, and thickness. Though, the functionality remains the same, despite the dimensional variances.

In some embodiments, a cog wheel may be disposed to attach to a first end of the discs for regulating the positioning and movement of the support members. The cog wheel may include a central axle and a plurality of peripheral rods that extend from one side of the cog wheel. The central axle may pass through each central aperture of the plurality of discs. Each peripheral rods may pass through a corresponding peripheral aperture in the discs. A spring may be positioned adjacently to the cog wheel to bias the cog wheel into engagement with the discs by engaging the aforementioned central axle and peripheral rods into the central aperture and peripheral apertures.

In some embodiments, a release member may be disposed to attach to a second end of the discs directly opposite to, and in alignment with the central axle. The release member may be configured to exert a force inwardly towards the discs and against the spring. The force is effective in disengaging the central axle from the central aperture and the peripheral rods from the peripheral apertures in the discs. In this manner, when the central axle is engaged with the central aperture, the cog wheel may help retain each arched member in a selected position relative to the furniture. When the central axle is disengaged from the central aperture through the release member, the discs are free to pivot the support members between the expanded and retracted positions.

In some embodiments, the device may include a canopy that mounts on the frame portion. The canopy is carried by the frame portion between the expanded position and retracted position. The canopy may include a plurality of tubular sleeves that receive each arched member. The canopy may form a solid protective barrier that is sufficiently malleable to form creases when stowed in the retracted position, and stretch out into an adjustable curvature from the expanded position. The canopy may include a plurality of fasteners for joining the device to the furniture.

FIG. 1 illustrates a detailed perspective view of an exemplary screening device, in accordance with an embodiment of the present invention. In the present invention, a screening device 100 detachably joins with furniture to provide protection against the elements. The furniture may include, without limitation, a sun lounge chair, a beach chair, a deck chair, a folding chair, a pool chair, a couch, and any chair that folds flat by a scissors action round a transverse axis. In some embodiments, the device may include a canopy 102 that is effective in screening a portion of the furniture from external elements, such as sun, rain, and wind. The canopy is carried by a plurality of support members 108 that serve as a frame. The canopy may utilize a plurality of tubular sleeves 104 to receive the support members. Additionally, the canopy may fasten to the furniture through a plurality of canopy fasteners 106, such as a hook and loop fastener.

In some embodiments, the device may pivot relative to the furniture to move between an expanded position for screening, and a retracted position for stowing. The pivoting motion may be performed as each support member pivots on a disc 110. A handle 112 that extends from the support member may be utilized to pull the device between the expanded and retracted positions. In one embodiment, the expanded position may include twelve points of expansion. In this manner, the screen may track the sun's movements. In some embodiments, the device may be portable for detachably joining with the furniture. The device may include variable lengths and an adjustable curvature in a longitudinal direction for optimal flexibility while providing a protective screen.

Figure 2A:
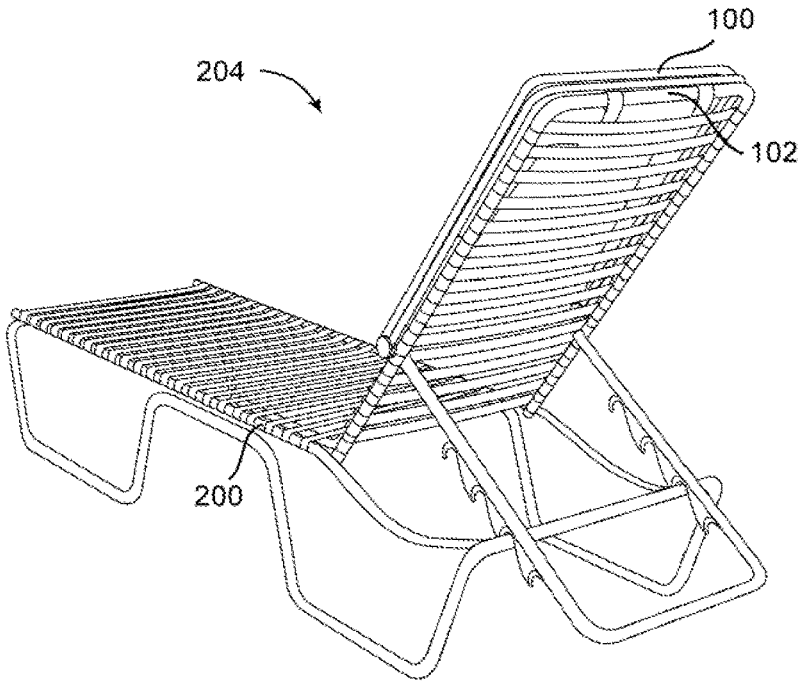
FIGS. 2A and 2B illustrate detailed perspective views of exemplary screening devices joined with a furniture, where
Figure 2B:
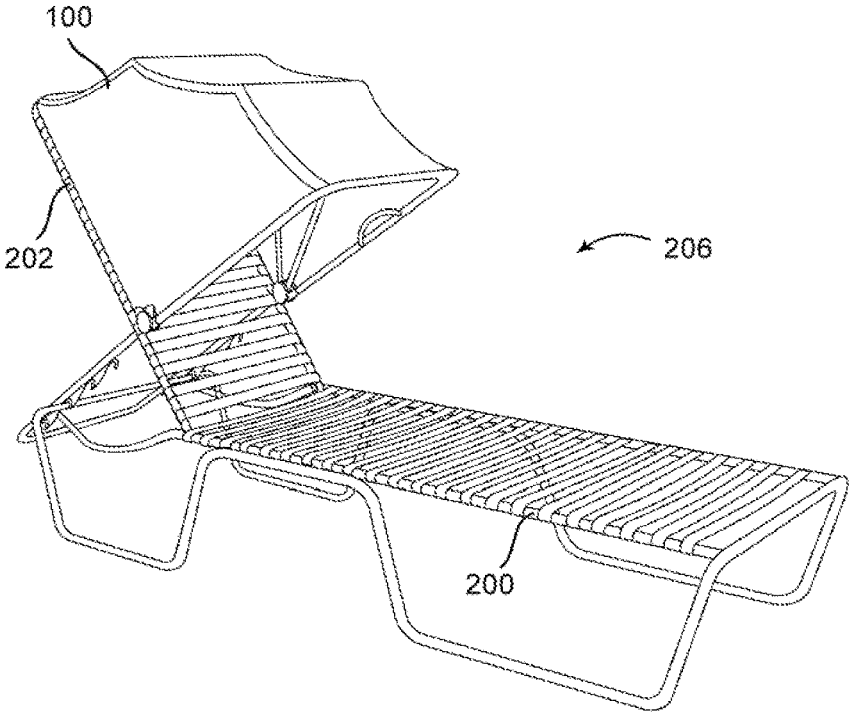

FIGS. 2A and 2B illustrate detailed perspective views of exemplary screening devices joined with a furniture, where FIG. 2A illustrates the screening device in an exemplary retracted position, and FIG. 2B illustrates the screening device in an exemplary expanded position, in accordance with an embodiment of the present invention. In the present invention, the device joins with a furniture 200. While attached to the furniture, the device may pivot between an expanded position 206 for providing a protective screen to an object on the furniture, and a retracted position 204 for stowing the device on the furniture when not in use. In one embodiment, the device may join with a furniture head portion 202. Those skilled in the art, in light of the present teachings, will recognize that a user resting on the furniture generally rests the head towards the head portion of the furniture. The user's head requires shade from the sun and protection from the rain. Thus, the device may be more effective—though not always the case—positioned on the furniture head portion of the furniture to screen the head from the elements.

Figure 3:
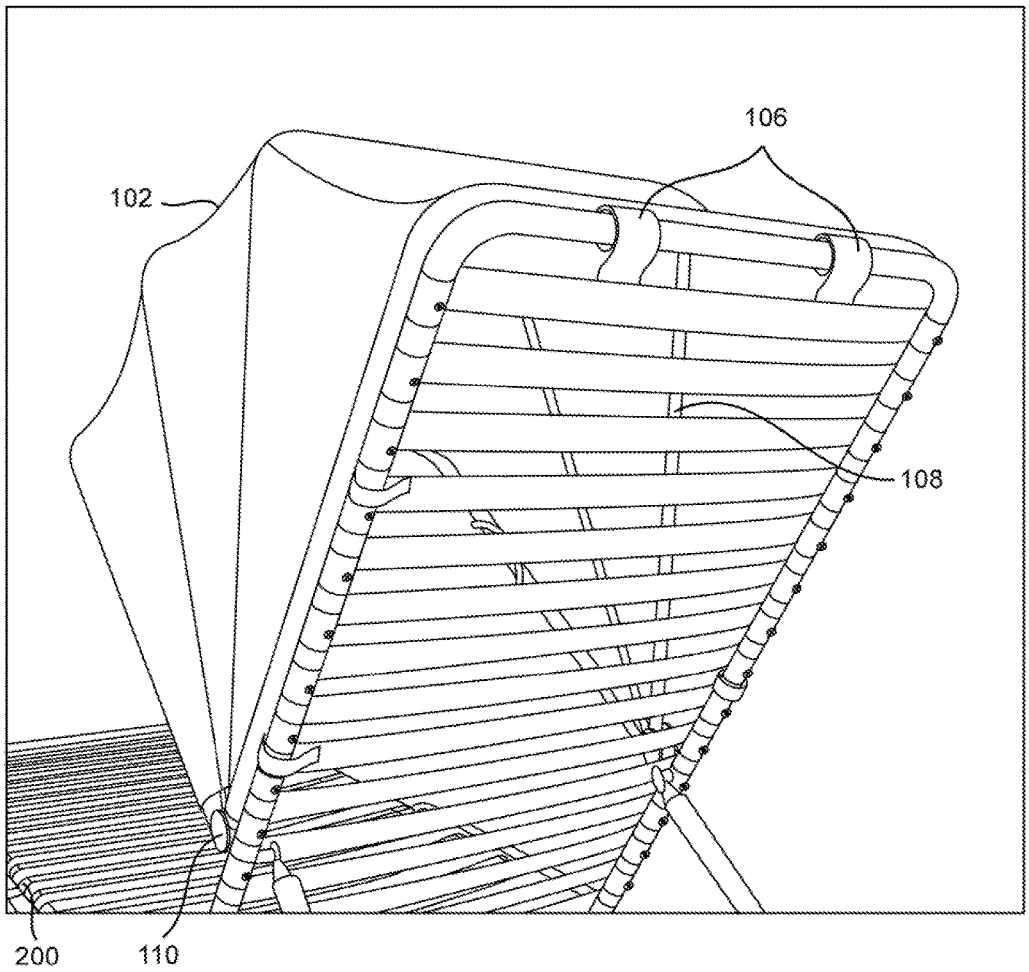
FIG. 3 illustrates a detailed perspective view of an exemplary screening device fastened to an exemplary furniture head portion, in accordance with an embodiment of the present invention.

FIG. 3 illustrates a detailed perspective view of an exemplary screening device fastened to an exemplary furniture head portion, in accordance with an embodiment of the present invention. In the present invention, the device may include a plurality of support members that form the structural support of the device and configured to carry a canopy. The support members may be configured to move the canopy in an accordion mechanism between the expanded and retracted positions. In one embodiment, the device comprises four support members. The support members may align in a generally parallel series, and with each support member having a substantially U-shaped configuration. In one embodiment, the support members include two outer support members having a diameter of at least 9/16", and two inner support members having a diameter of about 7/16". In another embodiment, a triangular, to "L" shapes joined together, round, and square.

Accordingly, the frame portion may be expanded or retracted so that the device may be utilized with substantially all of the known lounge chairs to protect the user from the elements. For example, without limitation, when the device is initially positioned on the head region of the lounge chair the frame portion and the canopy may be pivoted rearwardly to fold the device out of the way. The frame portion and the canopy can then be pivoted forwardly and expanded to overlay the user in superposed relationship with the lounge chair. When it is desired to collapse the canopy, this may be readily accomplished by pivotable movement of the support members to the desired position. Suitable materials for the support members may include, without limitation, high-density polyethylene (HDPE), high-impact polystyrene (HIPS), polyvinyl chloride (PVC), aluminum, stainless steel, wood, and any type of durable plastic as well as any combination of suitable materials such as but not limited to those just listed above.

Figure 4A:
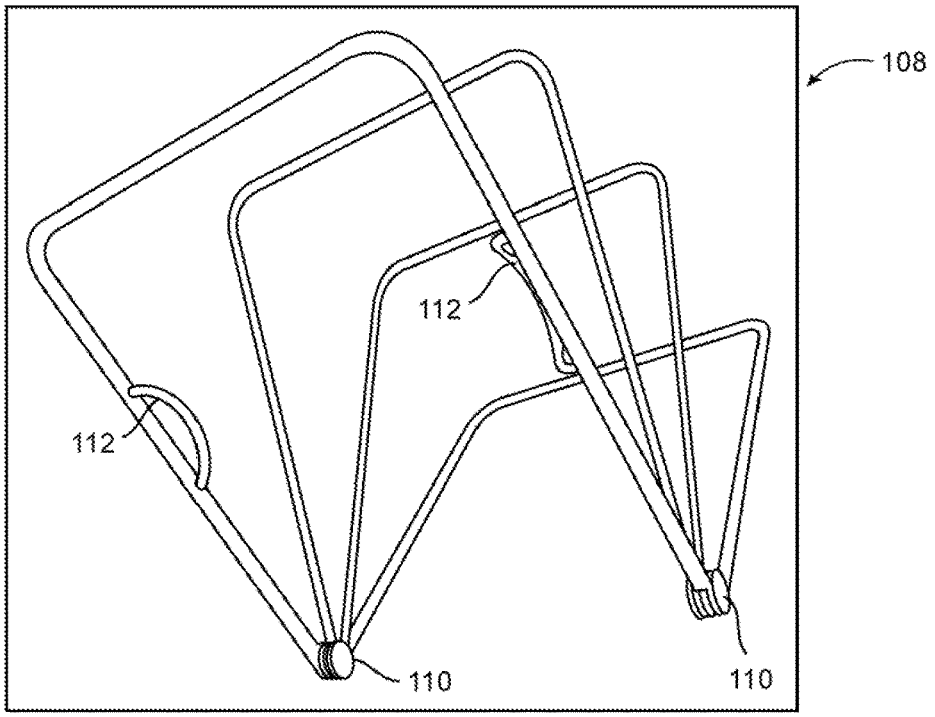
FIGS. 4A and 4B illustrate detailed perspective views of exemplary support members carrying an exemplary canopy, where
Figure 4B:
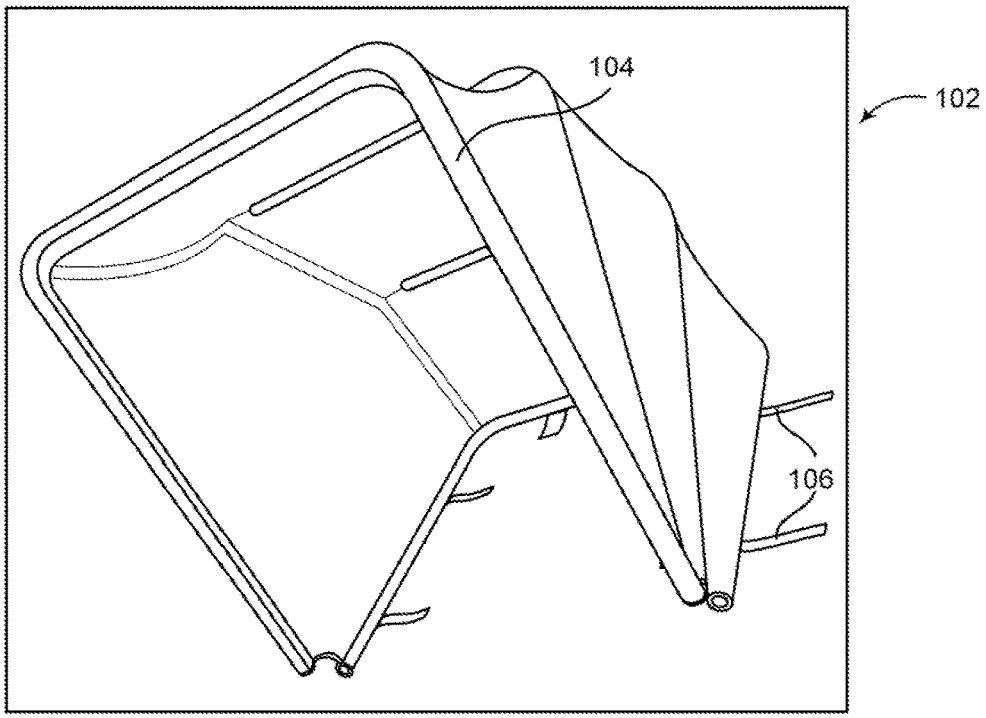

FIGS. 4A and 4B illustrate detailed perspective views of exemplary support members carrying an exemplary canopy, where FIG. 4A illustrates four exemplary support members, and FIG. 4B illustrates the canopy covering the support members, in accordance with an embodiment of the present invention. In the present invention, the device may include a canopy that mounts on the frame portion. In one embodiment, the canopy may have dimensions of a 22" width and a 40" length. However, any dimensions may be used, depending on the type and size of furniture. The canopy is carried by the frame portion between the expanded position and retracted position. The canopy may form a solid protective barrier that is sufficiently malleable to form creases when stowed in the retracted position, and stretch out into an adjustable curvature from the expanded position. In some embodiments, the canopy may include an ultraviolet reflective coating composition for enhanced protection against ultraviolet radiation.

In some embodiments, the canopy may include a plurality of tubular sleeves that receive each arched member. In one embodiment, the canopy may include a tubular sleeve along the rear edges, and two tubular sleeves along the top of the canopy. In some embodiments, the canopy may include a plurality of canopy fasteners configured to secure the canopy to the furniture. The canopy fasteners may include, without limitation, a hook and loop fastener, a string, a magnet, a rope, and an adhesive. Suitable materials for the canopy may include, without limitation, nylon, woven polyester, and blends of these and other materials. In some embodiments, the canopy may be made of non-waterproof materials, which may or may not be coated with a waterproof lining, which can be of various substances, such as but not limited to polyurethane and fluoropolymer. The canopy can also be made of a mesh allowing air to flow through.

Figure 5:
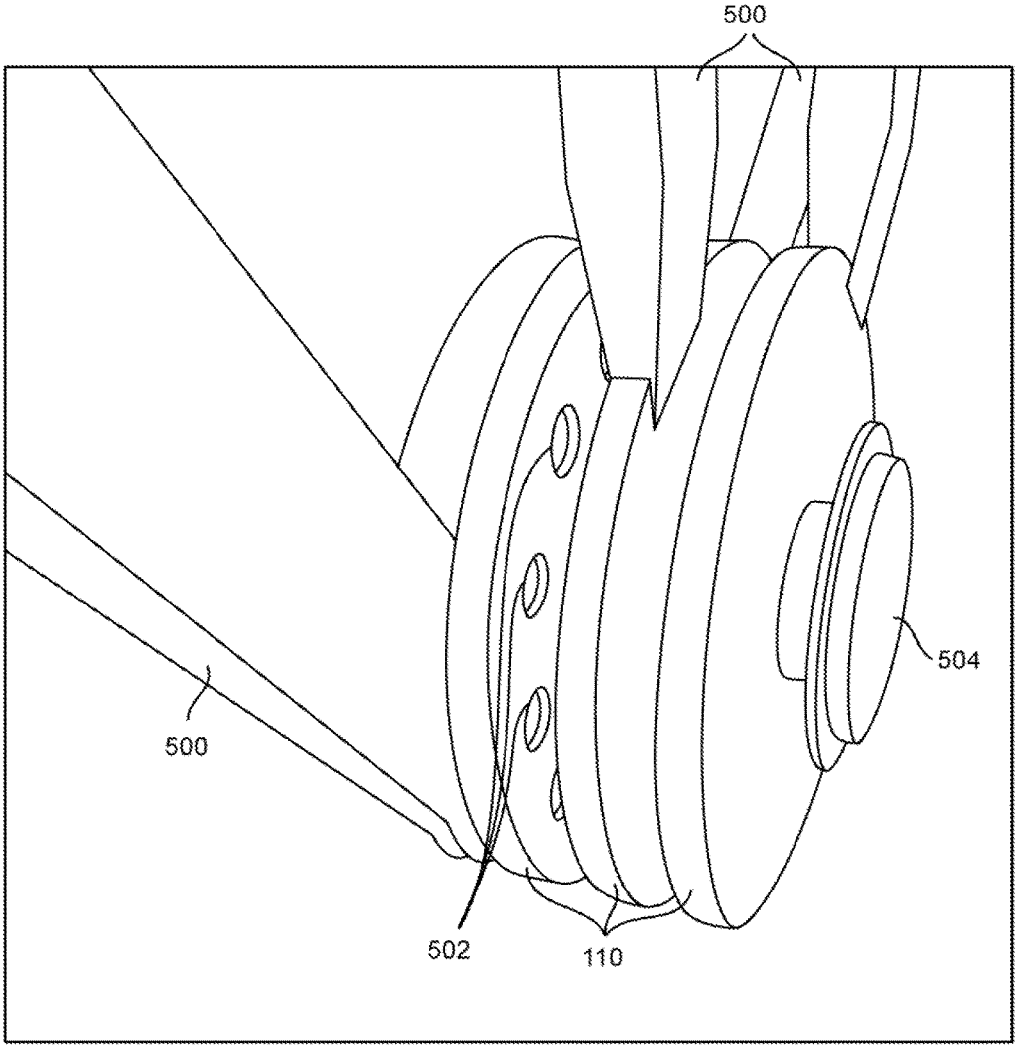
FIG. 5 illustrates a detailed perspective view of exemplary discs, in accordance with an embodiment of the present invention.

FIG. 5 illustrates a detailed perspective view of exemplary discs, in accordance with an embodiment of the present invention. In the present invention, In some embodiments, a strut 500 and an adjacently attached disc extend from the terminal ends of each support member. Each support member, thus may have two struts and two discs extending therefrom. In one embodiment, at least one handle may extend inwardly from a support member. The handle may be configured to move the support members to a desired position. The handle may include a generally U-shaped handle extending about ½" from the support member. The disc enables a smooth pivoting motion for moving between positions. Each disc comprises a central aperture for enabling pivoting, and a plurality of peripheral apertures 502 for alignment and retaining each arched member in a selected position relative to the furniture. In one embodiment, the strut and the disc are integrated together though plastic molding techniques. In another embodiment, a release member 504, such as a push button, facilitates the movement of the support members.

In some embodiments, each strut integrates into the corresponding support member to help resist longitudinal compression and create additional support. The strut design in conjunction with other elements allow the canopy to be adjusted in extension. Each disc is configured to interact with its companion disc to enable pivoting of the support members, and also to retain the support members in a selected position relative to the furniture. Each disc comprises a central aperture for enabling pivoting, and a plurality of peripheral apertures for alignment and retaining each arched member in a selected position relative to the furniture. In this manner, the companion support members pivot on the discs relative to each other, and relative to the furniture. In one embodiment, the plurality of peripheral apertures comprises twelve peripheral apertures. In some embodiments, the discs may have differences in diameter, shape, and thickness. Though, the functionality remains the same, despite the dimensional variances.

Figure 6:
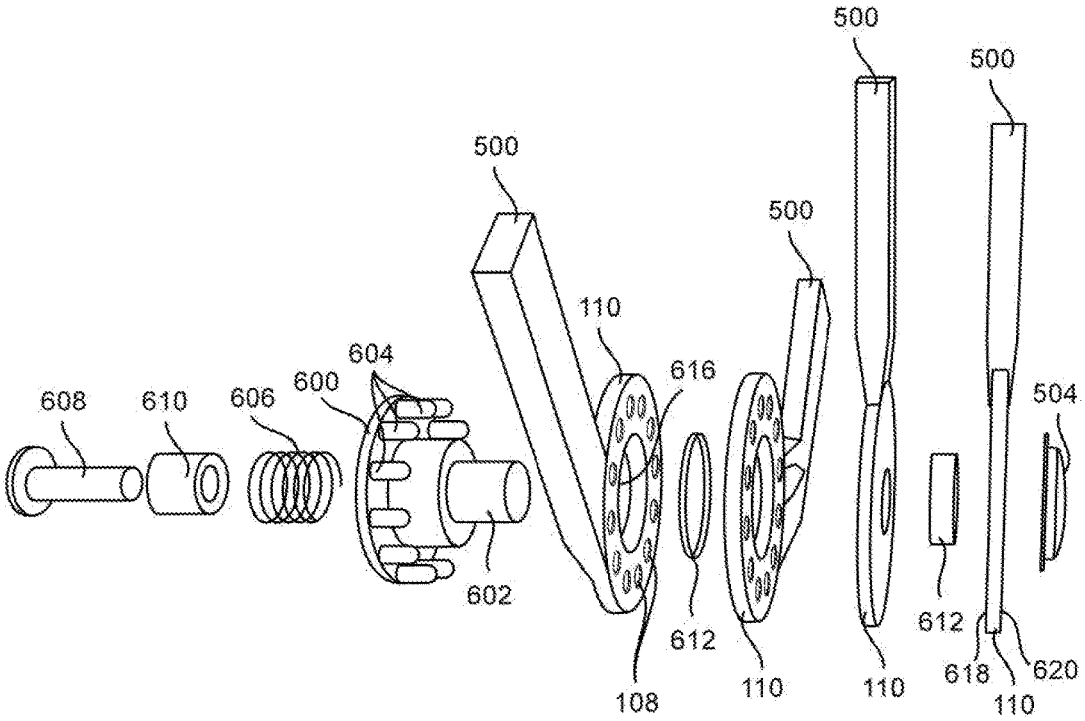
FIG. 6 illustrates a blow up view of exemplary discs, struts, cog wheel, and spring operatively positioned relative to each other, in accordance with an embodiment of the present invention.

FIG. 6 illustrates a blow up view of exemplary discs, struts, cog wheel, and spring operatively positioned relative to each other, in accordance with an embodiment of the present invention. In the present invention, a cog wheel 600 may be disposed to attach to a first end 618 of the discs for regulating the positioning and movement of the support members. The cog wheel may include a central axle 602 and a plurality of peripheral rods 604 that extend from one side of the cog wheel. The central axle from the cog wheel may pass through a central aperture 616. Additionally, each peripheral rod may pass through a corresponding peripheral aperture in the discs. In some embodiments, a spring 606 may be positioned adjacently to the cog wheel to bias the cog wheel into engagement with the discs by engaging the aforementioned central axle and peripheral rods into the central aperture and peripheral apertures, respectively.

In some embodiments, the device comprises a pin 608 configured to at least partially pass through said cog wheel and said spring for at least partially stabilizing the cog wheel relative to the disc. The pin may include, without limitation, a backing pin. A pin sleeve 610 is configured to enable at least partial passage of the pin. The device further comprises at least one spacer 612 disposed between each disc. The at least one spacer configured to facilitate pivoting by said plurality of support members. In one embodiment, a thick spacer rests between two outer discs, and a thin spacer rests between two inner discs.

In some embodiments, the release member may be disposed to attach to a second end 620 of the discs directly opposite to, and in alignment with the central axle. The release member may include a push button cap that positions adjacently to the end of the central axle. Spring loaded tabs (like those on crutches), cotter pin assembly, push button tabs. The release member may be configured to exert a force inwardly towards the discs and against the spring. The force is effective in disengaging the central axle from the central aperture and the peripheral rods from the peripheral apertures in the discs. In this manner, when the central axle is engaged with the central aperture, the cog wheel may help retain each arched member in a selected position relative to the furniture. When the central axle is disengaged from the central aperture through the release member, the discs are free to pivot the support members between the expanded and retracted positions.

Figure 7A:
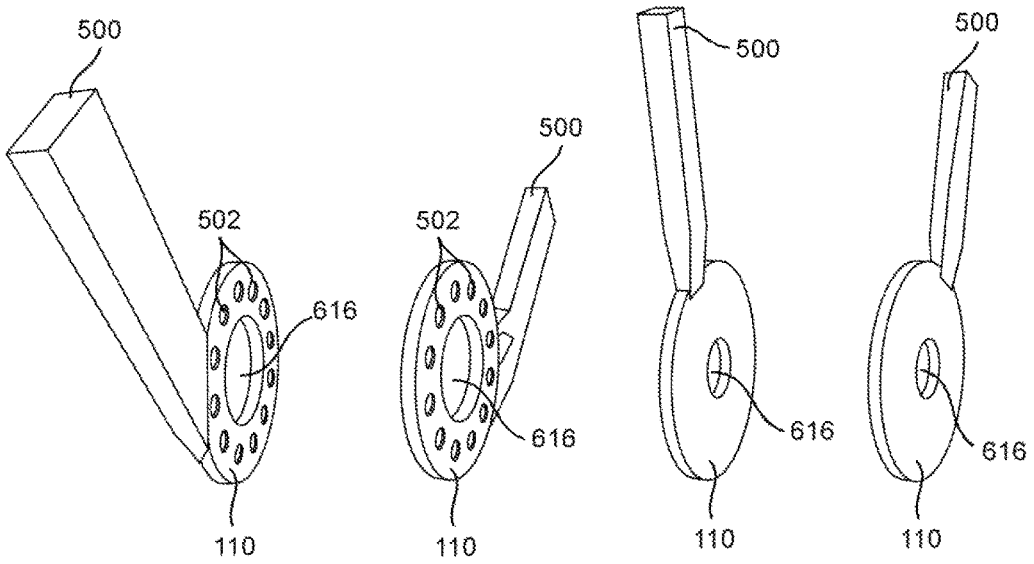
FIGS. 7A, 7B, and 7C illustrate detailed perspective views of exemplary pivoting components of an exemplary support member, where
Figure 7B:
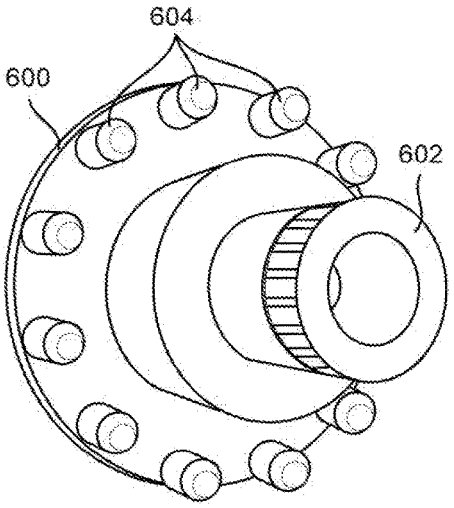
Figure 7C:
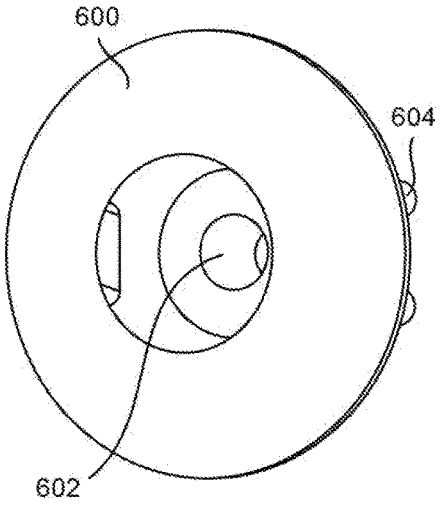

FIGS. 7A, 7B, and 7C illustrate detailed perspective views of exemplary pivoting components of an exemplary support member, where FIG. 7A illustrates exemplary disc and struts, FIG. 7B illustrates exemplary central axle and peripheral rods for a disc, and FIG. 7C illustrates a rear end of the disc, in accordance with an embodiment of the present invention. In the present invention, the plurality of peripheral rods may be utilized to help fasten the discs for each support member together. In one embodiment, the peripheral rods comprise twelve rods. However, a greater or lesser number of rods may be used. In another embodiment, the central axle from the cog wheel may pass through a central aperture from each of the discs by about ¼" to ⅓". This extra space allows the release member to force the central axle back to disengage the cog wheel form the discs.

In one alternative embodiment, the screening device may join with a table to provide a protective barrier to users sitting around the table. In another alternative embodiment, the screening device slides along a longitudinal axis of the lounge chair. In yet another alternative embodiment, the cog wheel has gear teeth to selectively move between the expanded and retracted positions.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a screening device that attaches to furniture and rotatably moves between an expanded position and a retracted position according to the present invention will be apparent to those skilled in the art. Various aspects of the invention have been described above by way of illustration, and the specific embodiments disclosed are not intended to limit the invention to the particular forms disclosed. The particular implementation of the screening device that attaches to furniture and rotatably moves between an expanded position and a retracted position may vary depending upon the particular context or application. By way of example, and not limitation, the screening device that attaches to furniture and rotatably moves between an expanded position and a retracted position described in the foregoing were principally directed to a canopy that pivots to provide shade on an outdoor lounge chair; however, similar techniques may instead be applied to any article of furniture, like a deck chair, a pool table, and a picnic bench and table, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A device comprising:

a plurality of support members, in which said plurality of support members comprising at least two inner support members and two outer support members, and in which each support member comprising a disc, wherein each disc of each support member is configured to pivot a respective support member between an expanded position and a retracted position;

a cog wheel comprising at least a central axle and at least six or more peripheral rods;

a spring implement, wherein said spring implement is disposed adjacent to said central axle of said cog wheel, wherein said spring implement being operable to bias said cog wheel into engagement with one of said discs;

a pin implement, wherein said pin implement is configured to at least partially pass through said central axle of said cog wheel;

a pin sleeve implement configured to enable at least a partial passage of said pin implement;

a first spacer implement, wherein said first spacer implement is disposed proximately between said two outer support member discs, and wherein said first spacer implement being configured to be operable for facilitating said pivoting of said two outer support members;

a second spacer implement, wherein said second spacer implement being disposed proximately between said two inner support member discs, wherein said second spacer implement being operable for facilitating said pivoting of said two inner supporting members;

a release member, said release member comprising at least a button, wherein said release member is configured to disengage said cog wheel from said disc for at least partially releasing said plurality of support members to pivot between said expanded position and said retracted position on said furniture;

a canopy fastening implement, wherein said canopy fastener is configured to fasten a canopy to said furniture; and a tubular sleeve implement, in which said tubular sleeve implement is configured to receive at least one of said plurality of support members.

2. The device of claim 1, in which said furniture comprises at least a chair, said chair comprising a transverse axis.

3. The device of claim 2, in which each support member is arranged in parallel series, wherein each support member is configured into a generally U shape.

4. The device of claim 3, in which each support member comprises at least a pair of terminal ends.

5. The device of claim 4, in which said pair of terminal ends comprises at least a strut.

6. The device of claim 5, in which each disc for each support member is configured to have, at least one of, a different dimension and a different size.

7. The device of claim 6, in which said two inner support member discs comprises at least a central aperture and a plurality of peripheral apertures.

8. The device of claim 7, in which said cog wheel further comprises at least a housing for holding said pin sleeve implement.

9. The device of claim 8, wherein said central axle is configured to at least partially pass through said two inner supporting member discs central apertures.

10. The device of claim 9, wherein said at least six or more peripheral rods are configured to at least partially pass through at least one of said plurality of peripheral apertures.

11. The device of claim 10, in which said pin sleeve implement being configured to be retained inside said cog wheel.

12. The device of claim 1, wherein said release member is configured to apply a force against said spring implement.

13. The device of claim 12, in which said pin implement is further configured to at least partially pass through said cog wheel and said spring implement.

14. The device of claim 13, in which said pin sleeve implement is configured to rest inside said cog wheel.

15. The device of claim 14, in which said first spacer implement is thicker than said second spacer implement.

16. The device of claim 1, further comprising a canopy, in which said canopy includes a waterproof lining or an ultraviolet reflective coating.

17. An apparatus consisting essentially of:

a plurality of support members disposed to join with a furniture, said furniture comprising a chair configured to fold flat by a scissors action around a transverse axis, said plurality of support members configured to carry a canopy, said canopy comprises a waterproof and ultra violet resistant fabric composition, each support member arranged in parallel series relative to each other, each support member configured into a generally U shape, each support member comprising a disc, each disc comprising a central aperture, wherein two inner discs comprising at least a plurality of peripheral apertures, each disc configured to pivot a respective support member between an expanded position and a retracted position, each support member further comprising a strut configured to help resist longitudinal compression and create additional support for said plurality of support members;

a cog wheel configured to engage each of said discs for at least partially restraining said plurality of support members, said cog wheel comprising a central axle and a plurality of peripheral rods;

a release member configured to disengage said cog wheel from each disc for at least partially releasing said plurality of support members to pivot between said expanded position and said retracted position;

a spring configured to bias said cog wheel into engagement with each disc;

a pin configured to at least partially pass through said cog wheel and said spring;

a pin sleeve configured to enable at least a partial passage of said pin;

a first spacer implement, wherein said first spacer implement is disposed proximately between the two outer support member discs, and wherein said first spacer implement being configured to be operable for facilitating said pivoting of two outer support members; and a second spacer implement, wherein said second spacer implement being disposed proximately between the two inner support member discs, wherein said second spacer implement being operable for facilitating said pivoting of said two inner supporting members.

* * * * *